US011879327B2

(12) United States Patent
Wu et al.

(10) Patent No.: US 11,879,327 B2
(45) Date of Patent: *Jan. 23, 2024

(54) SYSTEM AND METHOD OF TRANSIENT ELECTROMAGNETIC ADVANCED DETECTION

(71) Applicants: CHINA UNIVERSITY OF MINING AND TECHNOLOGY, BEIJING, Beijing (CN); WUHAN CHANGSHENG MINE SECURITY TECHNOLOGY LIMITED, Wuhan (CN)

(72) Inventors: Qiang Wu, Beijing (CN); Chunsheng Liu, Beijing (CN); Yifan Zeng, Beijing (CN); Liu Liu, Beijing (CN); Fengjuan Tao, Beijing (CN); Gang Hu, Beijing (CN)

(73) Assignees: CHINA UNIVERSITY OF MINING AND AND TECHNOLOGY, BEIJING, Beijing (CN); WUHAN CHANGSHENG MINE SECURITY TECHNOLOGY LIMITED, Wuhan (CN)

( * ) Notice: Subject to any disclaimer, the term of this patent is extended or adjusted under 35 U.S.C. 154(b) by 371 days.

This patent is subject to a terminal disclaimer.

(21) Appl. No.: 17/465,015

(22) Filed: Sep. 2, 2021

(65) Prior Publication Data

US 2022/0251945 A1 Aug. 11, 2022

(30) Foreign Application Priority Data

Feb. 5, 2021 (CN) ..... 202110162034.0

(51) Int. Cl.

| | |
|---|---|
| ***E21B 47/12*** | (2012.01) |
| ***E21B 47/04*** | (2012.01) |
| ***E21F 17/18*** | (2006.01) |

(52) U.S. Cl.

CPC ..... *E21B 47/12* (2013.01); *E21B 47/04* (2013.01); *E21F 17/18* (2013.01)

(58) Field of Classification Search

CPC ..... E21B 47/12; E21B 47/04; E21B 47/0232; E21B 47/113; E21B 49/00; E21F 17/18

See application file for complete search history.

(56) References Cited

U.S. PATENT DOCUMENTS

| | | | | |
|---|---|---|---|---|
| 2008/0068023 | A1* | 3/2008 | Peter | G01V 3/30 324/338 |
| 2009/0030615 | A1* | 1/2009 | Clark | E21B 47/0228 175/45 |
| 2010/0082255 | A1* | 4/2010 | Davydycheva | G01V 3/28 702/7 |
| 2013/0176139 | A1* | 7/2013 | Chau | E21B 7/046 340/854.4 |

(Continued)

*Primary Examiner* — Amine Benlagsir

(74) *Attorney, Agent, or Firm* — Westbridge IP LLC

(57) ABSTRACT

Disclosed is a system and a method of transient electromagnetic advanced detection. The system includes a detection host, an electromagnetic signal transmitter, a probe, and a communication device. The system and method of transient electromagnetic advance detection disclosed by examples of the present disclosure can realize an early-warning through a transient electromagnetic advance detection in a borehole while drilling the borehole in a tunnel or a roadway.

15 Claims, 3 Drawing Sheets

(56) References Cited

U.S. PATENT DOCUMENTS

| | | | | |
|---|---|---|---|---|
| 2013/0342210 | A1* | 12/2013 | Stokely | E21B 47/022 324/346 |
| 2016/0017706 | A1* | 1/2016 | Liu | E21B 47/13 340/853.2 |
| 2016/0123137 | A1* | 5/2016 | Liu | E21B 7/06 250/254 |
| 2016/0299252 | A1* | 10/2016 | Zacharko | E21B 49/00 |
| 2017/0342822 | A1* | 11/2017 | Wilson | E21B 47/135 |
| 2018/0003032 | A1* | 1/2018 | Donzier | G01V 3/26 |
| 2018/0038218 | A1* | 2/2018 | Hay | E21B 47/024 |
| 2018/0347353 | A1* | 12/2018 | Wang | E21B 47/12 |
| 2018/0348389 | A1* | 12/2018 | Jaaskelainen | E21B 47/107 |

* cited by examiner

SYSTEM AND METHOD OF TRANSIENT ELECTROMAGNETIC ADVANCED DETECTION

CROSS-REFERENCE TO RELATED APPLICATIONS

The present application claims priority of Chinese patent application 202110162034.0, filed on Feb. 5, 2021, the entire contents of which are incorporated herein by reference.

TECHNICAL FIELD

The present disclosure relates to geophysical electromagnetic exploration technology, and more particularly, to a system and a method of transient electromagnetic advanced detection.

BACKGROUND

Advance detections and predictions are important parts of mine roadway (tunnel) driving. In the driving process, geological conditions of a driving face must be evaluated in advance to ensure a rapid and safe driving of the mine roadway (tunnel). Moreover, hydrogeological conditions are important factors affecting the safety of roadway (tunnel). Therefore, it is necessary to detect all these conditions during the driving process.

Conventionally, hydrogeological conditions can be detected through borehole detection methods or geophysical detection methods. However, borehole detection methods are expensive, time-consuming, with limited exploration scope and easy to cause secondary accidents. However, due to the sensitivity of geophysical detection methods and the limitation of roadway driving space, most geophysical detection methods are difficult to be applied at the driving face.

SUMMARY

In view of the above, examples of the present disclosure provide a system and a method of transient electromagnetic advance detection. By this system and method, an early-warning can be achieved through a transient electromagnetic advance detection in a borehole in a tunnel or a roadway.

The system of transient electromagnetic advanced detection according to some examples of the present disclosure may include: a detection host, an electromagnetic signal transmitter, a probe, and a communication device.

The electromagnetic signal transmitter is connected to the detection host and arranged at one end of a drill rod away from a drill bit. The electromagnetic signal transmitter is configured to emit a transient electromagnetic signal in accordance with a detection control signal from the detection host.

The probe, arranged inside the other end of the drill rod and close to the drill bit, is configured to receive a secondary magnetic signal excited by the transient electromagnetic signal via a surrounding rock, generate a drilling trajectory based on positions of the probe, and send the secondary magnetic signal and the drilling trajectory to the detection host via the communication device.

The detection host is configured to determine a three-dimensional electromagnetic intensity of each coordinate point according to the secondary magnetic signal and the drilling trajectory, and determine a position of a harmful geological body in a borehole according to the three-dimensional electromagnetic intensity of each coordinate point.

The communication device is configured to establish a communication channel between the detection host and the probe.

According to some examples of the present disclosure, the drill rod may include a non-magnetic drill rod part disposed adjacent to the drill bit and a second drill rod part disposed away from the drill bit; wherein, the non-magnetic drill rod part is connected to the second drill rod part, and the probe is disposed inside the non-magnetic drill rod part.

According to some examples of the present disclosure, the second drill rod part is made of metal materials and the non-magnetic drill rod part is made of non-magnetic metal materials.

According to some examples of the present disclosure, a housing of the probe is made of non-magnetic metal materials.

According to some examples of the present disclosure, the electromagnetic signal transmitter comprises at least one transient electromagnetic signal transmitting coil, configured to transmit the transient electromagnetic signal in accordance with the detection control signal.

According to some examples of the present disclosure, the detection host comprises a transient electromagnetic signal transmitting circuit connected to the transient electromagnetic signal transmitting coil; wherein, the transient electromagnetic signal transmitting circuit is configured to control the transient electromagnetic signal transmitting coil.

According to some examples of the present disclosure, the transient electromagnetic signal transmitting circuit may include:

at least one transient electromagnetic signal transmitting unit; wherein, each of the at least on transient electromagnetic signal transmitting unit is connected to one transient electromagnetic signal transmitting coil for controlling the transient electromagnetic signal transmitting coil to transmit the transient electromagnetic signal;

a transmitting control circuit, connected to the at least one transient electromagnetic signal transmitting unit, is configured to transmit a control signal to the transient electromagnetic signal transmitting unit to enable the transient electromagnetic signal transmitting unit to control the transient electromagnetic signal transmitting coil.

According to some examples of the present disclosure, the transient electromagnetic signal transmitting unit may include: a full-bridge transmitting circuit, a power supply and a resistor connected in parallel across the full-bridge transmitting circuit; wherein, the full-bridge transmitting circuit comprises a first insulated gate bipolar transistor, a second insulated gate bipolar transistor, a third insulated gate bipolar transistor, a fourth insulated gate bipolar transistor, a first diode, a second diode, a third diode and a fourth diode; wherein, a gate electrode of the first insulated gate bipolar transistor is connected to the transmitting control circuit, a collector electrode of the first insulated gate bipolar transistor is connected to an anode of the power supply; an emitter electrode of the first insulated gate bipolar transistor is connected to one end of the resistor, and the other end of the resistor is connected to one end of the transient electromagnetic signal transmitting coil;

a gate electrode of the second insulated gate bipolar transistor is connected to the transmitting control circuit, a collector electrode of the second insulated gate bipolar transistor is connected to the anode of the power supply, and an emitter electrode of the second insulated gate bipolar transistor is connected to the other end of the transient electromagnetic signal transmitting coil;

a gate electrode of the third insulated gate bipolar transistor is connected to the transmitting control circuit, a collector electrode of the third insulated gate bipolar transistor is connected to one end of the resistor, and an emitter electrode of the third insulated gate bipolar transistor is connected to a cathode of the power supply;

a gate electrode of the fourth insulated gate bipolar transistor is connected to the transmitting control circuit, a collector electrode of the fourth insulated gate bipolar transistor is connected to the other end of the transient electromagnetic signal transmitting coil, and an emitter electrode of the fourth insulated gate bipolar transistor is connected to the cathode of the power supply;

an anode of the first diode is connected to the emitter electrode of the first insulated gate bipolar transistor, and a cathode of the first diode is connected to the collector electrode of the first insulated gate bipolar transistor;

an anode of the second diode is connected to the emitter electrode of the second insulated gate bipolar transistor, and a cathode of the second diode is connected to the collector electrode of the second insulated gate bipolar transistor;

an anode of the third diode is connected to the emitter electrode of the third insulated gate bipolar transistor, and a cathode of the third diode is connected to the collector electrode of the third insulated gate bipolar transistor;

an anode of the fourth diode is connected to the emitter electrode of the fourth insulated gate bipolar transistor, and a cathode of the fourth diode is connected to the collector electrode of the fourth insulated gate bipolar transistor.

According to some examples of the present disclosure, the system may further include:

a transient electromagnetic signal receiving coil, disposed on the electromagnetic signal transmitter and concentrically disposed with the transient electromagnetic signal transmitting coil, is configured to receive the transient electromagnetic signal transmitted by the transient electromagnetic signal transmitting coil;

a transient electromagnetic signal receiving circuit, disposed on the detection host and connected to the transient electromagnetic signal receiving coil, is configured to process the transient electromagnetic signal received by the transient electromagnetic signal receiving coil to obtain a transient electromagnetic detection data map.

According to some examples of the present disclosure, the communication device may include:

a first transmitter, configured to send a probe control command to the probe to activate the probe;

a first receiver, configured to receive the secondary magnetic signal and the drilling trajectory.

According to some examples of the present disclosure, the detection host may include:

a first transmitting circuit, coupled to the first transmitter, configured to control the first transmitter to transmit the probe control command;

a first receiving circuit, coupled to the first receiver, configured to control the first receiver to receive the secondary magnetic signal and the drilling trajectory.

According to some examples of the present disclosure, the probe may include:

a second receiver, configured to receive the probe control command sent by the first transmitter;

a second receiving circuit, connected to the second receiver, configured to process the probe control command and send the prove control command to a single chip microcomputer to activated the probe;

a second transmitter, configured to transmit the secondary magnetic signal and the drilling trajectory to the first receiver;

a second transmitting circuit, coupled to the second transmitter, configured to control the second transmitter to transmit the secondary magnetic signal and the drilling trajectory.

According to some examples of the present disclosure, the detection host is further configured to in response to determining there is a three-dimensional electromagnetic signal intensity of a coordinate point is greater than three times of an average variance of the three-dimensional electromagnetic signal intensities of all the coordinate points, determine a position of a harmful geological body based on the coordinate point and alarm.

Examples of the present disclosure also provide a method of transient electromagnetic advanced detection, including:

placing a drill rod in a borehole; wherein, a probe is located inside the borehole, and an electromagnetic signal transmitter is located at an orifice of the borehole;

transmitting, by an electromagnetic signal transmitter, a transient electromagnetic signal according to a detection control signal from a detection host;

receiving, by the probe, a secondary magnetic signal excited by the transient electromagnetic signal via a surrounding rock;

generating a drilling trajectory based on positions of the probe;

sending the secondary magnetic signal and the drilling trajectory to the detection host via a communication device;

determining, by the detection host, three-dimensional electromagnetic signal intensities of coordinate points according to the secondary magnetic signal and the drilling trajectory, and determining a position of a harmful geological body in the borehole according to the three-dimensional electromagnetic signal intensities.

It can be seen from the above examples, a transient electromagnetic advanced detection can be achieved by combining the borehole detection methods and the geophysical detection methods. Thus, geological features of rock layers with different radius distances around a borehole can be detected. Further, whether there is a harmful geological body such as a water-bearing body in a certain range around the borehole can be determined. In this way, the problem that a transient electromagnetic probe cannot be placed into the borehole to perform a transient electromagnetic detection due to borehole deformation or borehole collapse caused by crushing of the surrounding rock can be solved. Through the system and the method disclosed, not only the accuracy of geophysical detection can be improved, but also the number of boreholes drilled can be reduced.

BRIEF DESCRIPTION OF DRAWINGS

In order to illustrate examples of the present disclosure or the prior art more clearly, references will now be made to accompanying drawings which form a part hereof, and in which it will be apparent to those skilled in the art that the drawings described below are merely examples of the present disclosure, and that other drawings may be made without inventive effort.

DETAILED DESCRIPTION OF THE EMBODIMENTS

Figure 1:
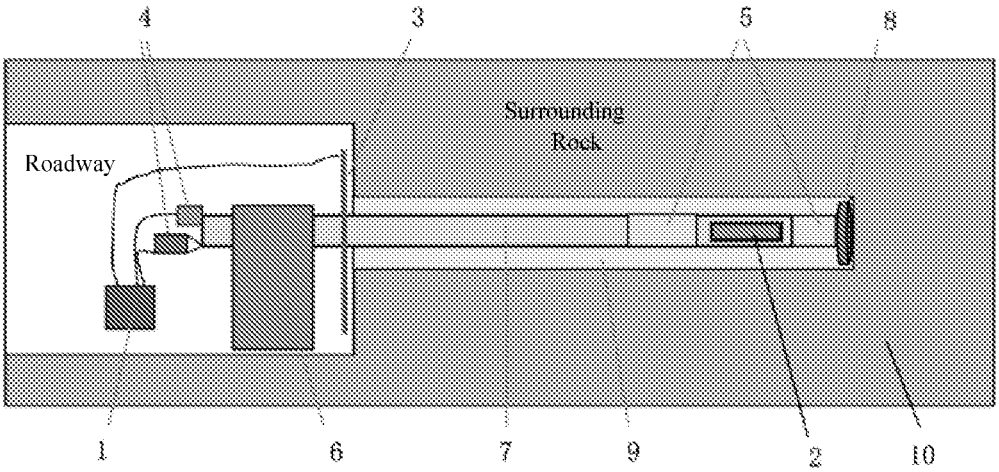
FIG. 1 is a schematic diagram illustrating the structure of a system of transient electromagnetic advanced detection according to examples of the present disclosure.

For a better understanding of the objects, aspects and advantages of the present disclosure, references will now be made to the following detailed description taken in conjunction with the accompanying drawings.

It should be noted that, unless defined otherwise, technical or scientific terms used in connection with examples of the present disclosure shall have ordinary meanings understood by those skilled in the art to which this disclosure belongs. As used in this disclosure, the terms "first", "second" and the like do not denote any order, quantity, or importance, but rather are used to distinguish one element from another. The word "comprise", "include" or the like means that an element or an article preceded by the word is inclusive of elements or articles listed after the word and their equivalents, however does not exclude other elements or articles. Similar terms such as "connect" is not limited to physical or mechanical connections, but may also include electrical connections, whether direct or indirect. "Above", "under", "left" and "right" are used merely to denote relative positional relationships, which may change accordingly when an absolute position of an object being described changes.

As mentioned in the background, hydrogeological conditions are important factors affecting the safety of tunnels. Generally, types of water that may exist in roadways (tunnels) may include: water-bearing fault belt, water-bearing subsided column, water accumulation in goaf, karst water-rich area and etc.

For the exploration of the above geological factors, borehole detection methods and geophysical detection methods are commonly used. Among these methods, the borehole detection methods are expensive and time-consuming, and the exploration scope is very limited. In addition, a drilling hole is easy to be a man-made passage for concealed water entering the roadway, which may cause secondary accidents. Geophysical detection methods include mine seismic reflection wave method, mine direct current method, mine electromagnetic method (transient electromagnetic method and radio wave penetration), Rayleigh surface wave method, geological radar, radioactive measurement and infrared temperature measurement methods. Geophysical detection methods have the advantages of low cost, rapid, large exploration range, long distance, and etc. However, due to the sensitivity characteristics of these methods and the limitation of roadway driving space, most methods are difficult to be applied at the driving face.

In addition, a traditional borehole detection is to pull out a drill rod after drilling, and then push the probe into the hole for detection. If the surrounding rocks of the borehole are soft rocks, they would be easy to collapse and then block the borehole, so that the probe cannot be put forward, therefore, the borehole detection cannot be performed. Further, the traditional borehole detection is to detect after drilling a final hole. If a hole is drilled through a water-bearing geological body in the drilling process, a lot of hazards to water plugging and prevention would be brought. Therefore, an early warning and a prediction when drilling cannot be achieved in real-time.

Through researches and experiments, inventors found that a detection device can be installed on a drill bit to implement a transient electromagnetic advanced detection in a borehole which is being drilled in a tunnel or a roadway. In this way, geological features of rock layers at different radial distances around the borehole can be detected, and harmful geological bodies such as water-bearing bodies can be determined in advance in a certain range around the borehole.

Hereinafter, technical solutions of the present disclosure will be described in further detail through specific examples.

Examples of the present disclosure provide a system of transient electromagnetic advanced detection. As shown in FIG. 1, the system of transient electromagnetic advanced detection includes a detection host 1, an electromagnetic signal transmitter 3, a probe 2, and a communication device 4.

In some examples of the present disclosure, the electromagnetic signal transmitter 3 is connected to the detection host 1 and arranged at one end of a drill rod away from a drill bit 8. The electromagnetic signal transmitter 3 is configured to emit a transient electromagnetic signal in accordance with a detection control signal from the detection host 1.

As shown in FIG. 1, when a detection is performed, the drill bit 8 and the drill rod would be inserted into a borehole 9 located in a surrounding rock 10. In this case, the electromagnetic signal transmitter 3 should be located at an aperture plane of the borehole 9 on the roadway wall, so that the signal emitting surface of the electromagnetic signal transmitter 3 may be perpendicular to the borehole 9, and the axis of the electromagnetic signal transmitter 3 may coincide with the axis of the borehole 9.

The probe 2 is connected to the detection host 1, and is arranged inside the other end of the drill rod and close to the drill bit 8. The probe 2 is configured to receive a secondary magnetic signal excited by the transient electromagnetic signal via the surrounding rock 10, generate a drilling trajectory based on positions of the probe, and send the secondary magnetic signal and the drilling trajectory to the detection host via the communication device.

In this example, the transient electromagnetic signal emitted by the electromagnetic signal transmitter 3, namely, a primary electromagnetic signal, is firstly transmitted in the surrounding rock 10. When the primary electromagnetic signal encounters a low-resistance body, a vortex electric field may be generated in the low-resistance body, and the vortex electric field may generate a secondary electromagnetic signal, namely, a secondary magnetic signal.

Moreover, whether a harmful geological body such as a water-bearing body is present can be detected based on the change of the secondary magnetic signal. At the same time, since the probe 2 and the electromagnetic signal transmitter 3 are respectively arranged at two ends of the drill rod, there is a certain distance between them. Thereby, a signal transmission space is provided for the transient electromagnetic signal emitted by the electromagnetic signal transmitter 3 to propagate.

In traditional transient electromagnetic detections in an underground coal mine, the electromagnetic signal transmitting device and the electromagnetic signal receiving device are often set together. The mutual inductance would be too strong, if the transmitter and the receiver are set together. That is, in the received signals, the primary electromagnetic signal sent by the electromagnetic signal transmitting device would be much stronger than the secondary magnetic signal transmitted from the surrounding rock. As a result, the secondary magnetic signal is hard to analysis, sometimes even unable to be separated from the primary electromagnetic signal. However, when the receiver is far away from the transmitter, the strength of the received primary electromagnetic signal may decrease and the strength of the received secondary magnetic signal may be larger, so that the detection may be performed easily.

The detection host 1 is configured to determine three-dimensional electromagnetic signal intensity of each coordinate point according to the secondary magnetic signal and the drilling trajectory, and determine a position of a harmful geological body in a borehole according to the three-dimensional electromagnetic signal intensity.

In the examples of the present disclosure, it can be determined whether there is a harmful geological body such as a water-bearing body based on the change of the secondary magnetic signal. Further, the positions of the probe 2 can be determined so as to determine the drilling trajectory. Moreover, the secondary magnetic signal and the drilling trajectory can be combined and then processed to obtain the three-dimensional electromagnetic signal intensity of each coordinate point. In this way, the position of the harmful geological body in the borehole can be determined according to pre-set conditions.

The communication device 4 is electrically connected to the detection host 1. The communication device 4 is configured to realize a communication between the detection host 1 and the probe 2 so as to realize signal transmissions therebetween.

Specifically, the detection host 1 or the probe 2 may compile a signal to be transmitted into an acoustic code and then transmits the acoustic code via the communication device 4 and the drill rod. As shown in FIG. 1, a conventional drill 6 is arranged at one end of the drill rod and the drill bit 8 is arranged at the other end of the drill rod. The communication device 4 is arranged on the side of the conventional drill 6 away from the drill bit 8. The probe 2 is arranged on the side of the drill bit 8 close to the conventional drill 6.

It can be seen from the above examples, a transient electromagnetic detection can be achieved by combining the borehole detection methods and the geophysical detection methods. Thus, geological features of rock layers with different radius distances around a borehole can be detected. Further, whether there is a harmful geological body such as a water-bearing body in a certain range around the boreholes can be determined. In this way, the problem that a transient electromagnetic probe cannot be placed into the borehole to perform a transient electromagnetic detection due to borehole deformation or borehole collapse caused by crushing of the surrounding rock can be solved. Through the system and the method disclosed, not only the accuracy of geophysical detection can be improved, but also the number of boreholes drilled can be reduced.

Figure 3:
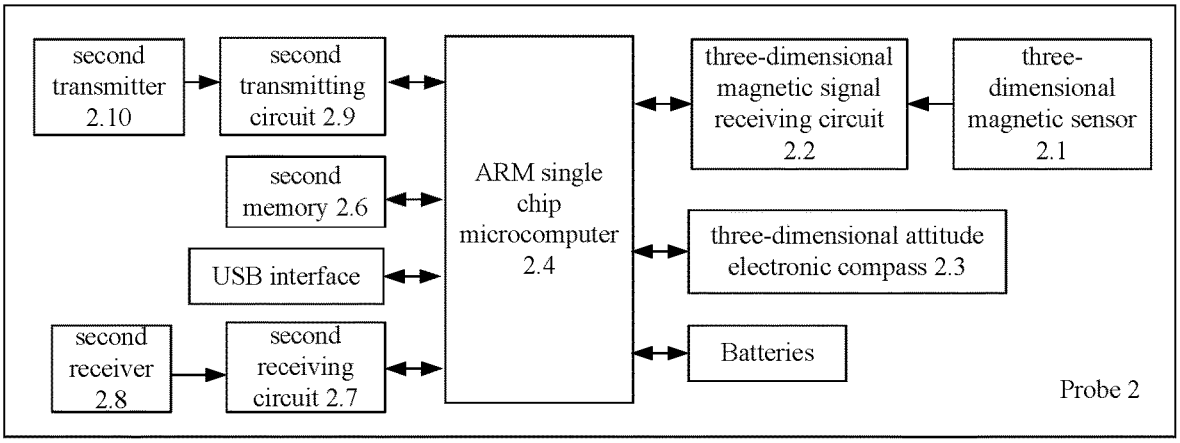
FIG. 3 is a schematic diagram illustrating the structure of a probe according some examples of the present disclosure.

In some examples of the present disclosure, as shown in FIG. 3, the probe 2 may include a three-dimensional magnetic sensor 2.1, a three-dimensional magnetic signal receiving circuit 2.2, a second memory 2.6 and a single chip microcomputer 2.4. After receiving a secondary magnetic signal, the three-dimensional magnetic sensor 2.1 sends the secondary magnetic signal to the single chip microcomputer 2.4 via the three-dimensional magnetic signal receiving circuit 2.2 for processing and then stores the secondary magnetic signal in the second memory 2.6 so as to facilitate subsequent processing.

In some examples of the present disclosure, the drill rod may include a non-magnetic drill rod part 5 arranged close to the drill bit 8 and a second drill rod part 7 arranged away from the drill bit 8. The non-magnetic drill rod part 5 is connected to the second drill rod part 7. The probe 2 is arranged inside the non-magnetic drill rod part 5, and a gap of 3-4 mm is provided between the probe 2 and the non-magnetic drill rod part 5, so as to cool the drill bit 8 by water or air while drilling to avoid a sharp decrease in the performance of the probe 2 due to the high temperature generated by the drill bit 8 while drilling the rocks and also to avoid a gas explosion caused by the high temperature.

As shown in FIG. 1, one end of the second drill rod part 7 is connected with the detection host 1, the other end is connected to one end of the non-magnetic drill rod part 5. The other end of the non-magnetic drill rod part 5 is connected to the drill bit 8. Wherein, the second drill rod part 7 may be made of metal materials, including high-quality alloy steels such as 30CrMnSi, 30CrMnSiA, 42CrMo, 45MnMoB, XJY850 and S135 alloy steels. The non-magnetic drill rod part 5 may be made of non-magnetic metal materials, including alloy materials such as non-magnetic stainless steel and beryllium copper.

In this example, both the second drill rod part 7 and the non-magnetic drill rod part 5 are made of metal materials. Since metal materials may also be elastic materials and be the best carrier of elastic waves, the communication device 4 can use the metal drill rod to realize signal transmissions. At the same time, the secondary magnetic signal received by the probe 2 is an excited magnetic signal. If the drill rod has magnetism, the resolution accuracy of the magnetic signal will be suppressed, therefore, the sensitivity of the receiving sensor would be reduced. For this reason, the non-magnetic drill rod part 5 should be made of non-magnetic metal materials. Due to the need for probing while drilling, the drill rod must be a strong material. Therefore, plastic material is not suitable. Since the drill rod is made of metal materials and metal materials have great shielding effects on electric signals, so only magnetic sensors can be used for transient electromagnetic detection.

Optionally, the housing of the probe 2 is made of a non-magnetic metallic material having a diameter of 30-50 mm, so as to avoid affecting the sensitivity of the probe 2.

In some examples of the present description, the electromagnetic signal transmitter 3 may include at least one transient electromagnetic signal transmitting coil. Each transient electromagnetic signal transmitting coil consists of a multi-turn cable and a separate wiring interface, and is wound in the shape of a square or a circle. Wherein, the side length of the transient electromagnetic transmitting coil is 2-3 m when the transient electromagnetic transmitting coil is in a shape of a square. The diameter of the transient electromagnetic transmitting coil is 2-3 m when the transient electromagnetic transmitting coil is in a shape of a circle. The transient electromagnetic signal transmitting coil is configured to emit the transient electromagnetic signal in accordance with the detection control signal.

Figure 2:
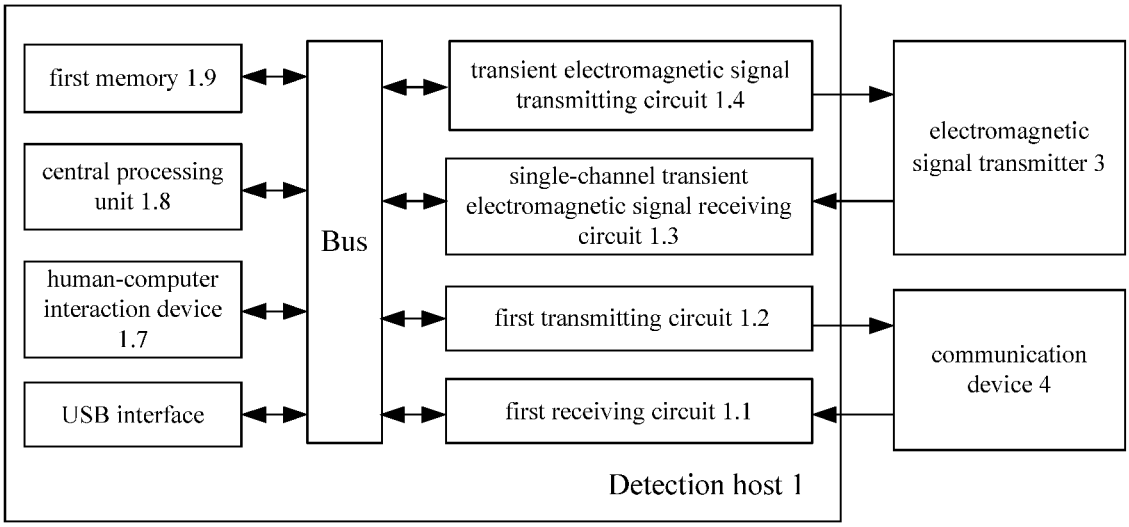
FIG. 2 is a schematic diagram illustrating the structure of a detection host according some examples of the present disclosure.

As shown in FIG. 2, the detection host 1 may include a transient electromagnetic signal transmitting circuit 1.4 connected to the transient electromagnetic signal transmitting coil. Wherein, the transient electromagnetic signal transmitting circuit 1.4 is configured to control the transient electromagnetic signal transmitting coil.

Figure 4:
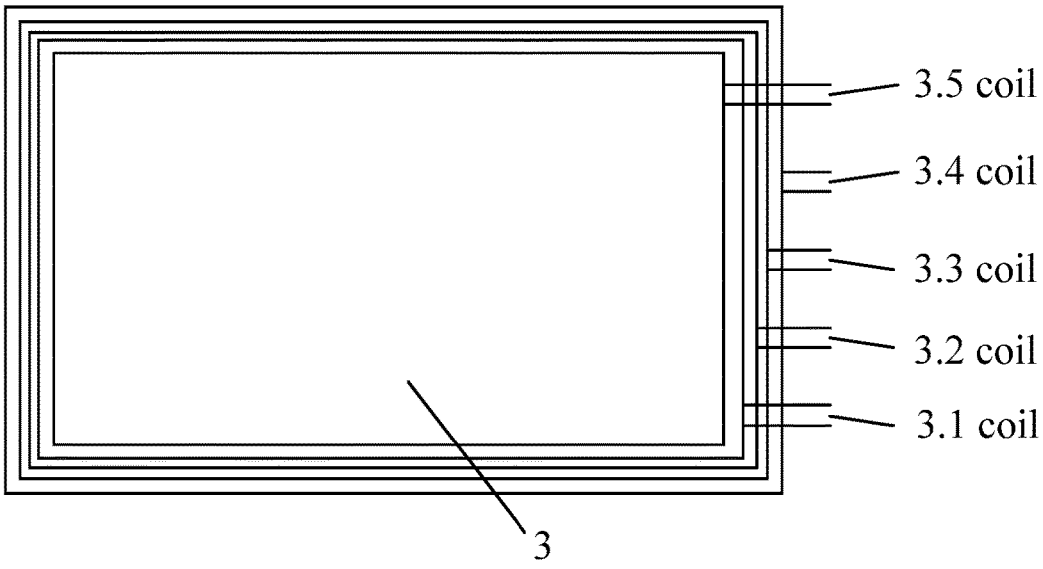
FIG. 4 is a schematic diagram illustrating the structure of an electromagnetic signal transmitter according to some examples of the present disclosure.

As shown in FIG. 4, the electromagnetic signal transmitter 3 includes four parallel transient electromagnetic signal transmitting coils 3.1, 3.2, 3.3 and 3.4. The detection host 1 can control the four transient electromagnetic signal transmitting coils 3.1, 3.2, 3.3 and 3.4 to emit the transient electromagnetic signal via the transient electromagnetic signal transmitting circuit 1.4. The transient electromagnetic signal is received by the three-dimensional magnetic field sensor 2.1 of the probe 2 after propagating through the surrounding rock 10 and exciting to generate a secondary magnetic signal. After being processed by the three-dimensional magnetic signal receiving circuit 2.2, it is stored in the second memory 2.6.

Figure 5:
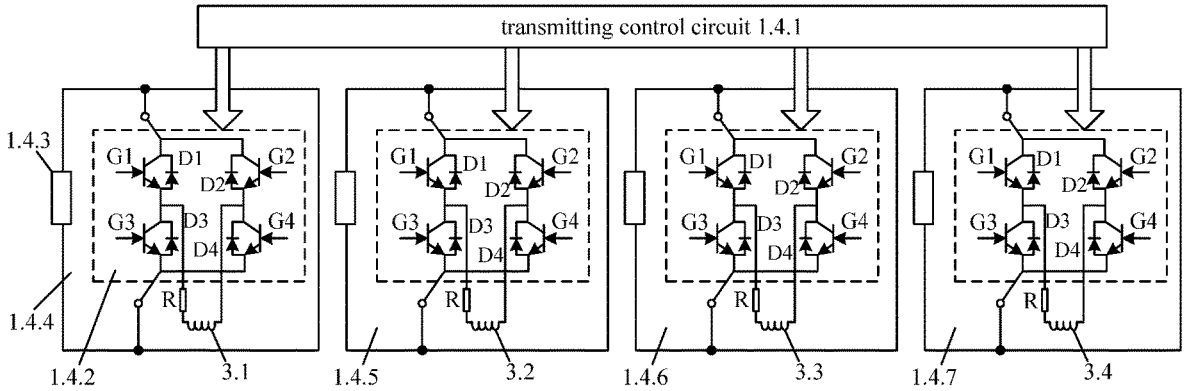
FIG. 5 is a schematic diagram illustrating the structure of a transient electromagnetic signal transmitting circuit according to some examples of the present disclosure.

In some examples of the present description, the transient electromagnetic signal transmitting circuit 1.4 may include a transmitting control circuit 1.4.1 and at least one transient electromagnetic signal transmitting unit. As shown in FIG. 5, the transient electromagnetic signal transmitting circuit 1.4 may include 4 transient electromagnetic signal transmitting units 1.4.4, 1.4.5, 1.4.6, and 1.4.7; wherein, each of the at least on transient electromagnetic signal transmitting unit is connected to one transient electromagnetic signal transmitting coil for controlling the transient electromagnetic signal transmitting coil to transmit the transient electromagnetic signal. A transmitting control circuit is connected to at least one of the transient electromagnetic signal transmitting units, and is used for sending a control signal to the transient electromagnetic signal transmitting unit so that the transient electromagnetic signal transmitting unit may control the transmission power of the transient electromagnetic signal transmitting coil and the number of transient electromagnetic signal transmitting coils, namely, controlling whether the transient electromagnetic signal is transmitted by one transient electromagnetic signal transmitting coil, or two transient electromagnetic signal transmitting coils, or three transient electromagnetic signal transmitting coils, or four transient electromagnetic signal transmitting coils.

In some examples of the present description, each transient electromagnetic signal transmitting unit may include a full-bridge transmitting circuit, a power supply and a resistor connected in parallel across the full-bridge transmitting circuit. As shown in FIG. 5, taking the transient electromagnetic signal transmitting unit 1.4.4 as an example, the transient electromagnetic signal transmitting unit 1.4.4 may include a full-bridge transmitting circuit 1.4.2, a power supply 1.4.3 and a resistor R connected in parallel across the full-bridge transmitting circuit 1.4.2. Wherein, the full-bridge transmitting circuit 1.4.2 may include a first insulated gate bipolar transistor G1, a second insulated gate bipolar transistor G2, a third insulated gate bipolar transistor G3, a fourth insulated gate bipolar transistor G4, a first diode D1, a second diode D2, a third diode D3 and a fourth diode D4.

Wherein, a gate electrode of the first insulated gate bipolar transistor G1 is connected to the transmitting control circuit 1.4.1, a collector electrode of the first insulated gate bipolar transistor G1 is connected to an anode of the power supply 1.4.3; an emitter electrode of the first insulated gate bipolar transistor G1 is connected to one end of the resistor R, and the other end of the resistor R is connected to one end of the transient electromagnetic signal transmitting coil 3.1. A gate electrode of the second insulated gate bipolar transistor G2 is connected to the transmitting control circuit 1.4.1, a collector electrode of the second insulated gate bipolar transistor G2 is connected to the anode of the power supply 1.4.3, and an emitter electrode of the second insulated gate bipolar transistor G2 is connected to the other end of the transient electromagnetic signal transmitting coil 3.1. A gate electrode of the third insulated gate bipolar transistor G3 is connected to the transmitting control circuit 1.4.1, a collector electrode of the third insulated gate bipolar transistor G3 is connected to one end of the resistor R, and an emitter electrode of the third insulated gate bipolar transistor G3 is connected to a cathode of the power supply 1.4.3. A gate electrode of the fourth insulated gate bipolar transistor G4 is connected to the transmitting control circuit 1.4.1, a collector electrode of the fourth insulated gate bipolar transistor G4 is connected to the other end of the transient electromagnetic signal transmitting coil 3.1, and an emitter electrode of the fourth insulated gate bipolar transistor G4 is connected to the cathode of the power supply 1.4.3.

An anode of the first diode D1 is connected to the emitter electrode of the first insulated gate bipolar transistor G1, and a cathode of the first diode D1 is connected to the collector electrode of the first insulated gate bipolar transistor G1. An anode of the second diode D2 is connected to the emitter electrode of the second insulated gate bipolar transistor G2, and a cathode of the second diode D2 is connected to the collector electrode of the second insulated gate bipolar transistor G2. An anode of the third diode D3 is connected to the emitter electrode of the third insulated gate bipolar transistor G3, and a cathode of the third diode D3 is connected to the collector electrode of the third insulated gate bipolar transistor G3. An anode of the fourth diode D4 is connected to the emitter electrode of the fourth insulated gate bipolar transistor G4, and a cathode of the fourth diode D4 is connected to the collector electrode of the fourth insulated gate bipolar transistor G4.

In some examples of the present disclosure, each insulated gate bipolar transistor is alternately switched on by the transmitting control circuit 1.4.1 so as to control the transient electromagnetic signal transmitting coil to emit a signal. Specifically, in a period, the first insulated gate bipolar transistor G1 and the fourth insulated gate bipolar transistor G4 are switched on, and the second insulated gate bipolar transistor G2 and the third insulated gate bipolar transistor G3 are switched off. In a next period, the first insulated gate bipolar transistor G1 and the fourth insulated gate bipolar transistor G4 are switched off, while the second insulated gate bipolar transistor G2 and the third insulated gate bipolar transistor G3 are switched on. At the same time, through the serial connected resistor and the transient electromagnetic signal transmitting coil, the transmission current can be controlled, and the requirements of coal mine explosion-proof can be met.

In some examples of the present disclosure, the electromagnetic signal transmitter 3 may be further provided with a transient electromagnetic signal receiving coil 3.5 and a single-channel transient electromagnetic signal receiving circuit 1.3. The transient electromagnetic signal receiving coil 3.5 is disposed on the electromagnetic signal transmitter and concentrically disposed with the transient electromagnetic signal transmitting coil. The transient electromagnetic signal receiving coil 3.5 is configured to receive the transient electromagnetic signal transmitted by the transient electromagnetic transmitting coil as a primary magnetic signal. The single-channel transient electromagnetic signal receiving circuit 1.3 is disposed on the detection host 1 and is connected to the transient electromagnetic receiving coil 3.5. The single-channel transient electromagnetic signal receiving circuit 1.3 is configured to process the transient electromagnetic signal received by the transient electromagnetic receiving coil 3.5 to obtain a transient electromagnetic detection data map. The transient electromagnetic detection data map may be stored in a first memory 1.9 by a central processing unit 1.8 arranged in the detection host 1 and displayed on a human-computer interaction device 1.7 of the detection host 1.

Figure 6:
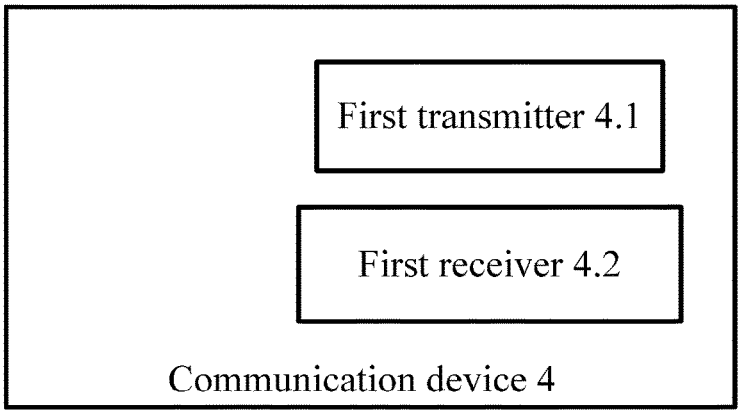
FIG. 6 is a schematic diagram illustrating the structure of a communication device according to some examples of the present disclosure.

In some examples of the present disclosure, as shown in FIG. 6, the communication device 4 may include a first transmitter 4.1 and a first receiver 4.2. Wherein the first transmitter 4.1 is configured to send a probe control command to the probe 2 to activate the probe 2. The first receiver 4.2 is configured to receive the secondary magnetic signal and the drilling trajectory.

In this example, when a detection starts, the detection host 1 may control the first transmitter 4.1 to compile a probe control command into a first acoustic code and then transmit the first acoustic code. The probe control command is then transmitted to the probe 2 via a common drill rod 7. After receiving the probe control command, the probe 2 translates the probe control command into a corresponding control command to control the probe 2 to work. After obtaining the secondary magnetic signal and the drilling trajectory, the probe 2 may compile the secondary magnetic signal and the drilling trajectory into a second acoustic code and sends the second acoustic code to the first receiver 4.2. The first receiver 4.2 may send the second acoustic code to the detection host 1 for subsequent processing.

According to some examples of the present disclosure, the detection host 1 may include: a first transmitting circuit 1.2 and a first receiving circuit 1.1. Wherein, the first transmitting circuit 1.2 is coupled to the first transmitter 4.1 and is configured to control the first transmitter 4.1 to transmit the probe control command. The first receiving circuit 1.2 is coupled to the first receiver 4.2, and is configured to control the first receiver 4.2 to receive the secondary magnetic signal and the drilling trajectory.

According to some examples of the present disclosure, the probe 2 may include: a second receiver 2.8, a second receiving circuit 2.7, a second transmitter 2.10 and a second transmitting circuit 2.9. Wherein, the second receiver 2.8 is configured to receive the probe control command sent by the first transmitter 4.1. The second receiving circuit 2.7 is connected to the second receiver 2.8, and is configured to process the probe control command and send the prove control command to a single chip microcomputer to activated the probe 2. The second transmitter 2.10 is configured to transmit the secondary magnetic signal and the drilling trajectory to the first receiver 4.2. The second transmitting circuit 2.9 is coupled to the second transmitter 2.10 and is configured to control the second transmitter 2.10 to transmit the secondary magnetic signal and the drilling trajectory.

In the example, when a detection starts, the detection host 1 may control the first transmitter 4.1 to compile a probe control command into a first acoustic code via the first transmitting circuit 1.2 and then transmits the first acoustic code to the second receiver 2.8. After receiving the first acoustic code, the second receiver 2.8 may send the first acoustic code to an ARM single chip microcomputer 2.4 of the probe 2 via the second receiving circuit 2.7. The ARM single chip microcomputer 2.4 interprets the first acoustic code and then controls the three-dimensional magnetic signal receiving circuit 2.2, the three-dimensional magnetic field sensor 2.1, the three-dimensional attitude electronic compass 2.3, the second transmitting circuit 2.9 and the second transmitter 2.10 of the probe 2 to operate.

After receiving the secondary magnetic signal, the three-dimensional magnetic field sensor 2.1 may transmit the secondary magnetic signal to the ARM single-chip microcomputer 2.4 for processing via the three-dimensional magnetic signal receiving circuit 2.2 and then send the secondary magnetic signal to the second memory 2.6 for storage. At the same time, in the detection process, the three-dimensional attitude electronic compass 2.3 may measure the trajectory of the probe 2, and store the drilling trajectory in the memory second memory 2.6.

Then, the ARM single chip microcomputer 2.4 may compile the secondary magnetic signal and the drilling trajectory into a second acoustic code, and send the second acoustic code to the communication device 4 via the second transmitting circuit 2.9 and the second transmitter 2.10. After receiving the second acoustic code, the first receiver 4.2 may send the second acoustic code to the central processing unit 1.8 of the detection host 1 via the first receiving circuit 1.1. Later, the central processing unit 1.8 may process the second acoustic code to obtain a final early-warning information.

According to some examples of the present disclosure, the detection host 1 is further configured to in response to determining there is a three-dimensional electromagnetic signal intensity of a coordinate point is greater than three times of an average variance of the three-dimensional electromagnetic signal intensities of all the coordinate points, determine a position of a harmful geological body based on the coordinate point and alarm.

Figure 7:
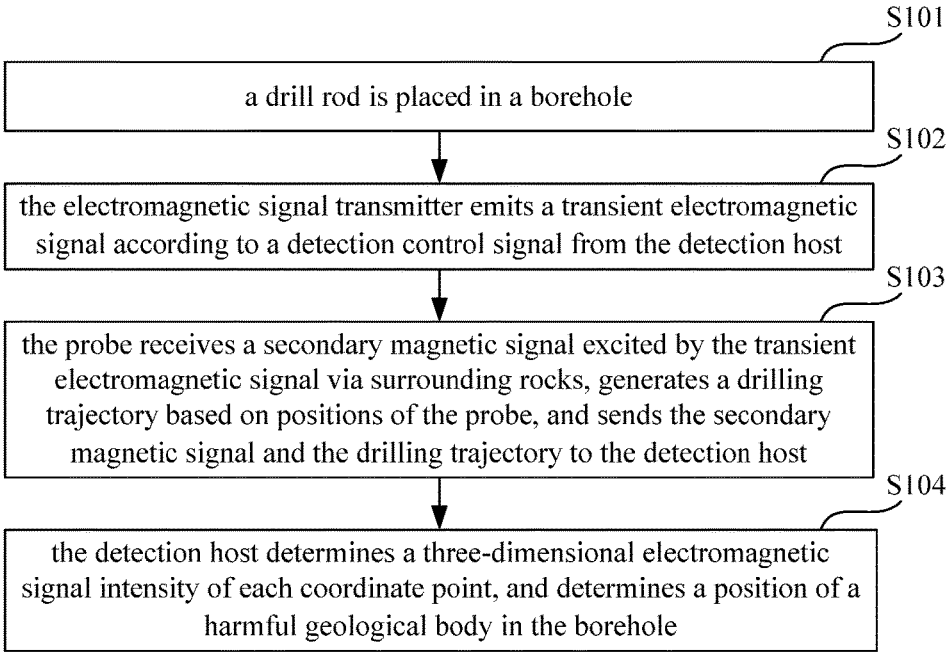
FIG. 7 is a schematic diagram illustrating a method of a transient electromagnetic advanced detection according some examples of the present disclosure.

Examples of the present disclosure also provide a method of a transient electromagnetic advanced detection. The method may be implemented by the system of a transient electromagnetic advanced detection described above. FIG. 7 is a schematic diagram illustrating a method of a transient electromagnetic advanced detection according some examples of the present disclosure. As shown in FIG. 7, the method may include the fowling steps.

In step S101, a drill rod is placed in a borehole.

In this case, the probe should be located inside the borehole and the electromagnetic signal transmitter should be located at the opening of the borehole.

In this step, the probe 2 would be installed in a non-magnetic drill rod 5 first. One end of the non-magnetic drill rod 5 is connected to a second drill rod 7 and the other end of the non-magnetic drill rod 5 is connected to a drill bit 8. In this step, the whole drill rod would be placed in the borehole 9 to be measured. Specifically, the transient electromagnetic signal transmitting coil of the electromagnetic signal transmitter 4 should be placed in the borehole 9 on the tunnel wall, the plane of the transient electromagnetic signal transmitting coil should be perpendicular to the borehole 9 to be measured, and the axis of the transient electromagnetic transmitting coil should coincide with the axis of the borehole 9 to be measured.

In step S102, the electromagnetic signal transmitter emits a transient electromagnetic signal according to a detection control signal from the detection host.

Before this step, when the drill rod enters the borehole 9, the detection host 1 may control the first transmitter 4.1 to transmit a probe control command via the first transmitting circuit 1.2 in the communication device 4. The probe control command may be transmitted to the second receiving circuit 2.7 through the non-magnetic drill rod 5, the second drill rod 7 and the second receiver 2.8 of the probe 2. And the prove would start to work accordingly.

In this step, after the probe 2 is activated, the detection host 1 may control at least one transient electromagnetic signal transmitting coil in the electromagnetic signal transmitter 3 to transmit a transient electromagnetic signal via the transient electromagnetic signal transmitting circuit 1.4. The transient electromagnetic signal may propagate to the periphery of the probe 2 via the surrounding rock 10 of the borehole 9 and excites a secondary magnetic signal. The three-dimensional magnetic field sensor 2.1 of the probe 2 may receive these magnetic signals, and perform a data processing procedure. Then the three-dimensional magnetic field sensor 2.1 may store the data in the second memory 2.6 via the three-dimensional magnetic signal receiving circuit 2.2. At the same time, the three-dimensional attitude electronic compass 2.3 of the probe 2 may measure the trajectory of the probe 2, and save is as a drilling trajectory in the second memory 2.6.

In step S103, the probe receives a secondary magnetic signal excited by the transient electromagnetic signal via surrounding rocks, generates a drilling trajectory based on positions of the probe, and sends the secondary magnetic signal and the drilling trajectory to the detection host via a communication device.

In this step, an ARM single-chip microcomputer 2.4 of the probe 2 may automatically compile the secondary magnetic signal and the drilling trajectory measured at a current point into an acoustic code, and transmits the acoustic code via the second transmitting circuit 2.9 and the second transmitter 2.10. Then the acoustic code is transmitted to the first receiver 4.2 at an outer end of the borehole 9 via the non-magnetic drill rod 5 and the second drill rod 7.

In step S104, the detection host determines a three-dimensional electromagnetic signal intensity of each coordinate point to be measured according to the secondary magnetic signal and the drilling trajectory, and determines a position of a harmful geological body in the borehole according to the three-dimensional electromagnetic signal intensity of each coordinate point to be measured.

In this step, signal processing is performed by the first receiving circuit 1.1 of the detection host 1. Specifically, the acoustic code is decoded via the central processing unit 1.8 to obtain the secondary magnetic signal and the drilling trajectory at the probe 2. Then the secondary magnetic signal and the drilling trajectory are stored in the first memory 1.9, and also displayed via the human-computer interaction device 1.7 of the detection host 1.

With the drilling of the drill bit 8 into the borehole 9, after drilling a length of a drill rod, the detection host 1 may perform the procedure from step S101 to step S104 once, until the depth of the borehole 9 reaches a designed depth. In this whole process, a transient electromagnetic advanced detection and a drilling trajectory measurement of the whole borehole 9 can be implemented.

At the same time, the detection host 1 may process and analysis the acquired secondary magnetic signal and the drilling trajectory so as to determine a three-dimensional electromagnetic signal intensity of each coordinate point to be measured, and then judge whether there is a three-dimensional electromagnetic signal intensity of a certain coordinate point greater than three times of a mean square error of the three-dimensional electromagnetic signal intensities of all coordinate points to be measured. In response to determining that there is a three-dimensional electromagnetic signal intensity of a certain coordinate point greater than three times of a mean square error of the three-dimensional electromagnetic signal intensities of all coordinate points to be measured, the detection host 1 may determine a position of a harmful geological body in the borehole based on the coordinate point and then alarm. The analysis method may be implemented according to the following expression.

$$M_{ij} = \frac{M_{1ij}}{M_{0ij}}$$

Wherein, $M_{ij}$ represents a secondary magnetic signal of a certain coordinate point j in a certain direction i of a normalized secondary magnetic field; $M_{0ij}$ represents the primary magnetic signal of the certain coordinate point j in the certain direction i of a direct primary magnetic field detected; $M_{1ij}$ represents a primary magnetic signal at the certain coordinate point j in the certain direction i of the excited secondary magnetic field; wherein i represents an x and y direction, and j represents a coordinate point, it can be 1, 2, 3, . . . , n.

When detecting while drilling, as the depth of the drilling hole deepens, the distance between the probe 2 and the electromagnetic signal transmitter 3 will gradually increases. As the distance increases, the received primary electromagnetic signal would become smaller. Moreover, the primary electromagnetic signals transmitted would be different due to the coupling of strata. Thus, the received secondary magnetic signal would vary with the distance and the strength of the coupling of strata. Therefore, it is necessary to remove the changes of the primary field signal caused by emission and distance. That is, the signal should be normalized so as to evaluate the magnitude of the generated secondary magnetic signal with the primary field signal of unit intensity.

The central processing unit 1.8 of the detection host 1 may perform a calculation processing according to the three-dimensional secondary magnetic signal obtained after normalization, and generate a new transient electromagnetic detection data map. Then, in combination with the drilling trajectory of the borehole 9, data in the transient electromagnetic detection data map that are more than three times of the mean square error of all the data are determined as abnormal data generated by an abnormal body. Since a low-resistance body is easy to generate a large magnetic signal and the resistance of the water-bearing body is low, a water-bearing body can be detected by determining whether there is a low-resistance body in the surrounding rock 10 around the borehole 9 to be detected. If there is a water-bearing body, the specific position of the water-bearing body is can be obtained. In this way, a prediction can be made, so as to realize an advanced detection and prediction of the borehole 9 to be detected.

In the above-mentioned examples, if it is determined that there is a water-bearing body in the surrounding rock of the borehole 9 to be measured, the detection host 1 may use the magnitude and direction (positive and negative) values of the three-dimensional magnetic signal to determine a direction on which the water-bearing body is in the three-dimensional body of the borehole 9 to be measured according to the transient electromagnetic detection data map of the entire depth of the borehole 9 to be measured and the drilling trajectory of the borehole 9 to be measured obtained in the above steps.

The system and method of transient electromagnetic advanced detection disclosed can perform a real-time pre-warning of transient electromagnetic advanced detection while drilling a tunnel or a roadway, and can detect harmful geological bodies such as water-bearing bodies and water-conducting channels in a range of 0-40 meters around the drilling hole.

Compared with conventional advanced prediction devices and methods, the system and method disclosed can realize transient electromagnetic advanced detection of a borehole while drilling, can detect the geological characteristics of rock layers with different radius distances around the borehole, and can determine whether there are harmful geological bodies such as water-bearing bodies in a certain range around the borehole. In this way, the problem that a transient electromagnetic probe cannot be placed into the borehole to perform a transient electromagnetic detection due to borehole deformation or borehole collapse caused by crushing of the surrounding rock can be solved. Through the system and the method disclosed, not only the accuracy of geophysical detection can be improved, but also the number of boreholes drilled can be reduced.

It should be noted that the foregoing describes certain example of the present disclosure. Other examples are within the scope of the claims. In some cases, the steps recited in the claims may be executed out of the order of the examples and still achieve desirable results. Additionally, the processes depicted in the accompanying figures do not necessarily require the particular order shown, or sequential order, to achieve desirable results. Multi-tasking and parallel processing are also possible or may be advantageous in some embodiments.

One of ordinary skill in the art will appreciate that the discussion of any of the above examples is merely exemplary and is not intended to imply that the scope of the disclosure, including the claims, is limited to these examples. Combinations between the features of the above examples are also possible within the contemplation of the present disclosure. The steps may be implemented in any order, and there are many other variations to different aspects of the disclosure as described above which are not provided in detail for the sake of brevity.

The disclosed examples are intended to embrace all such alterations, modifications and variations that fall within the broad scope of the appended claims. Accordingly, it is intended to embrace all such alternatives, modifications, equivalents, and variations that fall within the spirit and scope of the present disclosure.

What is claimed is:

1. A system of transient electromagnetic advanced detection, comprising:

a detection host, an electromagnetic signal transmitter, a probe, and a communication device; wherein, the electromagnetic signal transmitter, connected to the detection host and arranged at one end of a drill rod away from a drill bit, is configured to emit a transient electromagnetic signal in accordance with a detection control signal from the detection host;

the probe, arranged inside another end of the drill rod and close to the drill bit, is configured to receive a secondary magnetic signal excited by the transient electromagnetic signal via surrounding rocks, generate a drilling trajectory based on positions of the probe, and send the secondary magnetic signal and the drilling trajectory to the detection host via the communication device;

the detection host is configured to determine a three-dimensional electromagnetic signal intensity of each coordinate point of a plurality of coordinate points according to the secondary magnetic signal and the drilling trajectory, and determine a position of a harmful geological body in a borehole according to the three-dimensional electromagnetic signal intensity of said each coordinate point of the plurality of coordinate points; and the communication device is configured to establish a communicative connection between the detection host and the probe.

2. The system of claim 1, wherein the drill rod comprises a non-magnetic drill rod part disposed adjacent to the drill bit and a second drill rod part disposed away from the drill bit;

the non-magnetic drill rod part is coupled to the second drill rod part, and the probe is disposed inside the non-magnetic drill rod part.

3. The system of claim 2, wherein the second drill rod part is made of metal materials and the non-magnetic drill rod part is made of non-magnetic metal materials.

4. The system of claim 1, wherein a housing of the probe is made of non-magnetic metal materials.

5. The system of claim 1, wherein the electromagnetic signal transmitter comprises at least one transient electromagnetic signal transmitting coil of a plurality of transient electromagnetic signal transmitting coils, configured to transmit the transient electromagnetic signal in accordance with the detection control signal; and the detection host comprises a transient electromagnetic signal transmitting circuit connected to the at least one transient electromagnetic signal transmitting coil; wherein, the transient electromagnetic signal transmitting circuit is configured to control the at least one transient electromagnetic signal transmitting coil.

6. The system according to claim 5, wherein the transient electromagnetic wavo signal transmitting circuit comprises:

at least one transient electromagnetic signal transmitting unit of a plurality of transient electromagnetic signal transmitting units; wherein, each of the at least one transient electromagnetic signal transmitting unit is connected to the at least one transient electromagnetic signal transmitting coil for controlling the at least one transient electromagnetic signal transmitting coil to transmit the transient electromagnetic signal; and a transmitting control circuit, connected to the at least one transient electromagnetic signal transmitting unit, is configured to transmit a control signal to the at least one transient electromagnetic signal transmitting unit to enable the at least one transient electromagnetic signal transmitting unit to control the at least one transient electromagnetic signal transmitting coil.

7. The system of claim 6, wherein the at least one transient electromagnetic signal transmitting unit comprises: a full-bridge transmitting circuit, a power supply and a resistor connected in parallel across the full-bridge transmitting circuit; wherein, the full-bridge transmitting circuit comprises a first insulated gate bipolar transistor, a second insulated gate bipolar transistor, a third insulated gate bipolar transistor, a fourth insulated gate bipolar transistor, a first diode, a second diode, a third diode and a fourth diode.

8. The system of claim 7, wherein, a gate electrode of the first insulated gate bipolar transistor is connected to the transmitting control circuit, a collector electrode of the first insulated gate bipolar transistor is connected to an anode of the power supply; an emitter electrode of the first insulated gate bipolar transistor is connected to one end of the resistor, and another end of the resistor is connected to one end of the at least one transient electromagnetic signal transmitting coil;

a gate electrode of the second insulated gate bipolar transistor is connected to the transmitting control circuit, a collector electrode of the second insulated gate bipolar transistor is connected to the anode of the power supply, and an emitter electrode of the second insulated gate bipolar transistor is connected to another end of the at least one transient electromagnetic signal transmitting coil;

a gate electrode of the third insulated gate bipolar transistor is connected to the transmitting control circuit, a collector electrode of the third insulated gate bipolar transistor is connected to the one end of the resistor, and an emitter electrode of the third insulated gate bipolar transistor is connected to a cathode of the power supply; and a gate electrode of the fourth insulated gate bipolar transistor is connected to the transmitting control circuit, a collector electrode of the fourth insulated gate bipolar transistor is connected to the other end of the transient electromagnetic signal transmitting coil, and an emitter electrode of the fourth insulated gate bipolar transistor is connected to the cathode of the power supply.

9. The system of claim 7, wherein, an anode of the first diode is connected to an emitter electrode of the first insulated gate bipolar transistor, and a cathode of the first diode is connected to a collector electrode of the first insulated gate bipolar transistor;

an anode of the second diode is connected to an emitter electrode of the second insulated gate bipolar transistor, and a cathode of the second diode is connected to a collector electrode of the second insulated gate bipolar transistor;

an anode of the third diode is connected to an emitter electrode of the third insulated gate bipolar transistor, and a cathode of the third diode is connected to a collector electrode of the third insulated gate bipolar transistor; and an anode of the forth diode is connected to an emitter electrode of the fourth insulated gate bipolar transistor, and a cathode of the fourth diode is connected to a collector electrode of the fourth insulated gate bipolar transistor.

10. The system of claim 5, further comprising:

a transient electromagnetic signal receiving coil, disposed on the electromagnetic signal transmitter and concentrically disposed with the at least one transient electromagnetic signal transmitting coil, is configured to receive the transient electromagnetic signal transmitted by the at least one transient electromagnetic signal transmitting coil; and a single-channel transient electromagnetic signal receiving circuit, disposed on the detection host and connected to the transient electromagnetic signal receiving coil, is configured to process the transient electromagnetic signal received by the transient electromagnetic signal receiving coil to obtain a transient electromagnetic detection data map.

11. The system of claim 10, wherein the probe comprises:

a second receiver, configured to receive a probe control command sent by a first transmitter;

a second receiving circuit, connected to the second receiver, configured to process the probe control command and send the probe control command to a single chip microcomputer to activate the probe;

a second transmitter, configured to transmit the secondary magnetic signal and the drilling trajectory to a first receiver; and a second transmitting circuit, coupled to the second transmitter, configured to control the second transmitter to transmit the secondary magnetic signal and the drilling trajectory.

12. The system of claim 1, wherein the communication device comprises:

a first transmitter, configured to send a probe control command to the probe to activate the probe; and a first receiver, configured to receive the secondary magnetic signal and the drilling trajectory.

13. The system of claim 12, wherein the detection host comprises:

a first transmitting circuit, coupled to the first transmitter, configured to control the first transmitter to transmit the probe control command; and a first receiving circuit, coupled to the first receiver, configured to control the first receiver to receive the secondary magnetic signal and the drilling trajectory.

14. The system of claim 1, wherein the detection host is further configured to, in response to determining there is a three-dimensional electromagnetic signal intensity of a first coordinate point is greater than three times of a mean square error of the three-dimensional electromagnetic signal intensity of said each coordinate point of the plurality of coordinate points, determine the position of the harmful geological body in the borehole based on said each coordinate point of the plurality of coordinate points and alarm.

15. A method of transient electromagnetic advanced detection, comprising:

placing a drill rod in a borehole;

wherein, a probe is located inside the borehole, and an electromagnetic signal transmitter is located at an orifice of the borehole;

transmitting, by the electromagnetic signal transmitter, a transient electromagnetic signal according to a detection control signal from a detection host;

receiving, by the probe, a secondary magnetic signal excited by the transient electromagnetic signal via surrounding rocks;

generating, by the probe, a drilling trajectory based on positions of the probe;

sending, by the probe, the secondary magnetic signal and the drilling trajectory to the detection host via a communication device;

determining, by the detection host, three-dimensional electromagnetic signal intensities of coordinate points according to the secondary magnetic signal and the drilling trajectory; and determining, by the detection host, a position of a harmful geological body in the borehole according to the three-dimensional electromagnetic signal intensities.

* * * * *